United States Patent [19]

Suzuki et al.

[11] Patent Number: 5,059,098

[45] Date of Patent: Oct. 22, 1991

[54] APPARATUS FOR VARYING CAPACITY OF SCROLL TYPE COMPRESSOR

[75] Inventors: Shinichi Suzuki; Takashi Ban; Tetsuhiko Fukanuma; Tetsuo Yoshida, all of Kariya, Japan

[73] Assignee: Kabushiki Kaisha Toyoda Jidoshokki Seisakusho, Aichi, Japan

[21] Appl. No.: 469,940

[22] Filed: Jan. 25, 1990

[30] Foreign Application Priority Data

Feb. 2, 1989 [JP] Japan ..... 1-24286

[51] Int. Cl.[5] ..... F04B 49/00

[52] U.S. Cl. ..... 417/295; 417/299; 417/310

[58] Field of Search ..... 417/310, 299, 295

[56] References Cited

U.S. PATENT DOCUMENTS

| | | | |
|---|---|---|---|
| 4,431,388 | 2/1984 | Eber | 417/295 |
| 4,642,034 | 2/1987 | Terauchi | 417/299 |
| 4,886,425 | 12/1989 | Itahana | 417/310 |

*Primary Examiner*—Leonard E. Smith
*Assistant Examiner*—Alfred Basichas
*Attorney, Agent, or Firm*—Burgess, Ryan & Wayne

[57] ABSTRACT

In a scroll type of compressor having a stationary scroll, a movable scroll opposed to the stationary scroll and rotatable thereabout but not rotatable about its own axis, so that a closed chamber which decreases in volume during the rotation of the movable scroll is defined by and between the stationary scroll and the movable scroll, and an introduction passage through which a coolant is introduced into the compressor, wherein a capacity varying apparatus comprises a suction restriction mechanism provided in the introduction passage to control the cross sectional area thereof in accordance with the pressure of the coolant, a by-pass passage extending through the stationary scroll to connect the portion of the closed chamber connected to start ends of scroll portions provided on the movable and stationary scrolls, while being reduced in volume, to suction pressure area in the compressor, a by-pass opening and closing mechanism provided in the by-pass passage to open and close the latter in accordance with the pressure of the coolant, and a control valve actuated in accordance with the pressure of the coolant before being restricted, to control the operation of the suction restriction mechanism and the by-pass opening and closing mechanism.

16 Claims, 2 Drawing Sheets

21
23a
22
22d
23
22b
24
22e
22a
22c
2
18
S2
2a
19
9c
20
9e
14
9a
15
9
9d
II
11a
12B
8b
8a
7
9b
11a
12B
8
11
S1
10
5
13
10a
12A
3
13
R
10a
4a
6
12A
1a
16a
16
1
50
17
4

APPARATUS FOR VARYING CAPACITY OF SCROLL TYPE COMPRESSOR

BACKGROUND OF THE INVENTION

1. Field of the Invention

The present invention relates to an apparatus for varying a capacity in a scroll type compressor having a stationary scroll and a movable scroll opposed to the stationary scroll and rotatable about the stationary scroll but not about its own axis, to reduce the capacity of a closed space defined between the stationary scroll and the movable scroll.

2. Description of the Related Art

In a conventional scroll type compressor as disclosed, for example, in Japanese Unexamined Patent Publication (Kokai) No. 61-291792, a volume-reducing area of a closed space connected to the start end of a scroll portion provided at the base end of the stationary scroll is connected to a suction pressure area by a by-pass passage running from a rear side of the base end of the stationary scroll. The by-pass passage has a by-pass opening and closing mechanism provided therein to control the opening and closing of the by-pass passage in association with a coolant pressure. The by-pass opening and closing mechanism is provided with a piston which opens and closes the by-pass passage, and an electromagnetic valve which controls the introduction of the discharge coolant (gas) into a cylinder chamber in which the piston is housed. When the electromagnetic valve is in an open position, the discharge coolant (gas) flows into the cylinder chamber, so that the piston is urged to assume a closed position, by which the by-pass passage is closed, against a return spring.

When the electromagnetic valve is in the closed position, however, no discharge coolant enters the cylinder chamber, and thus the piston is brought to the open position, in which the by-pass passage is opened, by the return spring. Consequently, when the electromagnetic valve is closed, the coolant under compression is returned to the suction pressure area, to reduce the discharge capacity.

In such a known scroll type compressor, however, when the compressor rotates at a high speed, since the closed space which is being reduced in volume instantaneously passes through an inlet of the by-pass passage, often no coolant is returned to the suction pressure area through the inlet of the by-pass passage, in comparison with a smaller number of revolutions of the compressor. To solve the problem, the inlet of the by-pass passage can be made larger, to effectively increase the capacity variability of the compressor especially at a large number of revolutions thereof, but an enlargement of the inlet of the by-pass passage increases the quantity of the coolant returned to the suction pressure area therethrough, thus resulting in an excess variation of the capacity at a low rotational speed. On the contrary, if the inlet is designed to optimize the capacity variation at the low rotational speed of the compressor, a sufficient capacity variability cannot be obtained at a high rotational speed.

Japanese Unexamined Patent Publication (Kokai) No. 62-46164 discloses a suction restricting mechanism which controls the flow rate of the suction coolant and a by-pass opening and closing mechanism associated therewith. In this suction restricting mechanism, the restriction is controlled by the pressure of the coolant before the restriction acts directly on a restricting valve.

The control of the by-pass passage opening and closing mechanism is effected by the pressure difference between the suction pressures before and after the suction restricting mechanism, so that the closing of the by-pass passage is effected by a rotary valve which constitutes the by-pass passage opening and closing mechanism. The rotary valve is connected to a piston, and a pressure difference of the suction pressures on the opposite sides of the piston before and after the suction restricting mechanism causes the piston to move to rotate the rotary valve. Namely, when the introduction of the suction coolant is restricted, the by-pass passage is opened. Conversely, when a large flow rate of the suction coolant occurs, the by-pass passage is closed. Accordingly, the associated use of the suction restricting mechanism and the by-pass opening and closing mechanism makes it possible to widen the rotational speed range of the compressor in which a highly effective capacity variability can be obtained.

Nevertheless, a precise control of the closure and opening of the by-pass passage and the restriction cannot be achieved by such a direct control mechanism in which the rotation of the rotary valve is directly controlled by opposing suction pressures before and after the suction restricting mechanism, i.e., the suction pressure prior to restriction in which no cooling load is reflected and the suction pressure after the restriction, and such a direct control mechanism of the restriction in which the restriction is controlled by a direct action of the suction pressure on which the cooling load is reflected onto the restricting valve. In particular, it is very difficult to obtain an optimum capacity variability within a total range of from the low rotational speed to the high rotational speed.

SUMMARY OF THE INVENTION

The primary object of the present invention is to provide an apparatus for varying a capacity in a scroll type compressor in which an optimum capacity variability can be achieved over the entire rotational speed range, from a low speed to a high speed.

To achieve the object mentioned above, in a scroll type of compressor having a stationary scroll, a movable scroll opposed to the stationary scroll and rotatable thereabout but not rotatable about its own axis, so that a closed chamber which decreases in volume during the revolution of the movable scroll is defined by and between the stationary scroll and the movable scroll, and an introduction passage through which a coolant is introduced into the compressor, according to the present invention, a capacity varying apparatus comprises a suction restriction mechanism provided in the introduction passage to control the cross sectional area thereof in association with a pressure of the coolant, a by-pass passage extending through the stationary scroll to connect the portion of the closed chamber connected to the start ends of scroll portions provided on the movable and stationary scrolls, while being reduced in volume, to a suction pressure area in the compressor, a by-pass opening and closing mechanism provided in the by-pass passage to open and close the by-pass passage in accordance with the pressure of the coolant, and a control valve means actuated in accordance with the pressure of the coolant before being restricted to control the operation of the suction restriction mechanism and the by-pass opening and closing mechanism in association with each other.

With this arrangement, in the by-pass opening and closing mechanism, although the capacity varying effect is reduced as the rotational speed becomes higher, in the suction restriction mechanism, the path resistance of the coolant is increased as the rotational speed becomes higher, resulting in an enhanced capacity variability.

Accordingly, the associated controls of the by-pass opening and closing mechanism, which exhibits a high capacity variability in a slow rotational speed area, and the suction restriction mechanism, which exhibits a high capacity variability in a high rotational speed area, compensate for the respective weak variability areas which exist when those mechanisms are alone used. Since the closing and opening of the by-pass passage is controlled by the selective introduction of the discharge coolant pressure and the suction coolant pressure, a precise and certain control can be obtained and thus an optimum capacity variability can be achieved over an entire speed range of from a high speed to a low speed.

BRIEF DESCRIPTION OF THE DRAWINGS

The invention will be described below in detail with reference to the accompanying drawings, in which.

DESCRIPTION OF THE PREFERRED EMBODIMENTS

Figure 1:
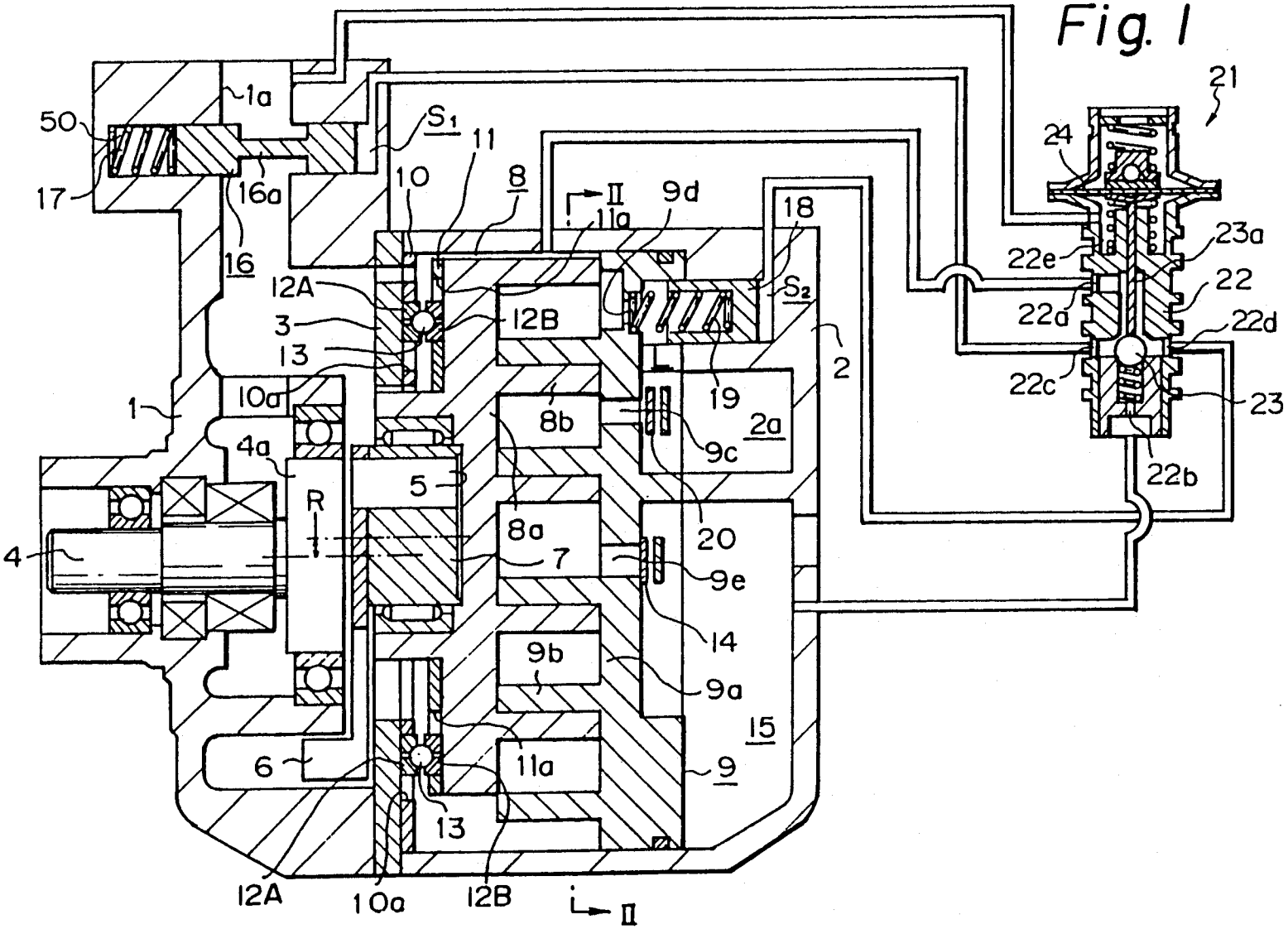
FIG. 1 is a side sectional view of an apparatus for varying a capacity in a scroll type compressor, according to an aspect of the present invention; and, FIG. 2 is a sectional view taken along the line II—II in FIG. 1.
Figure 2:
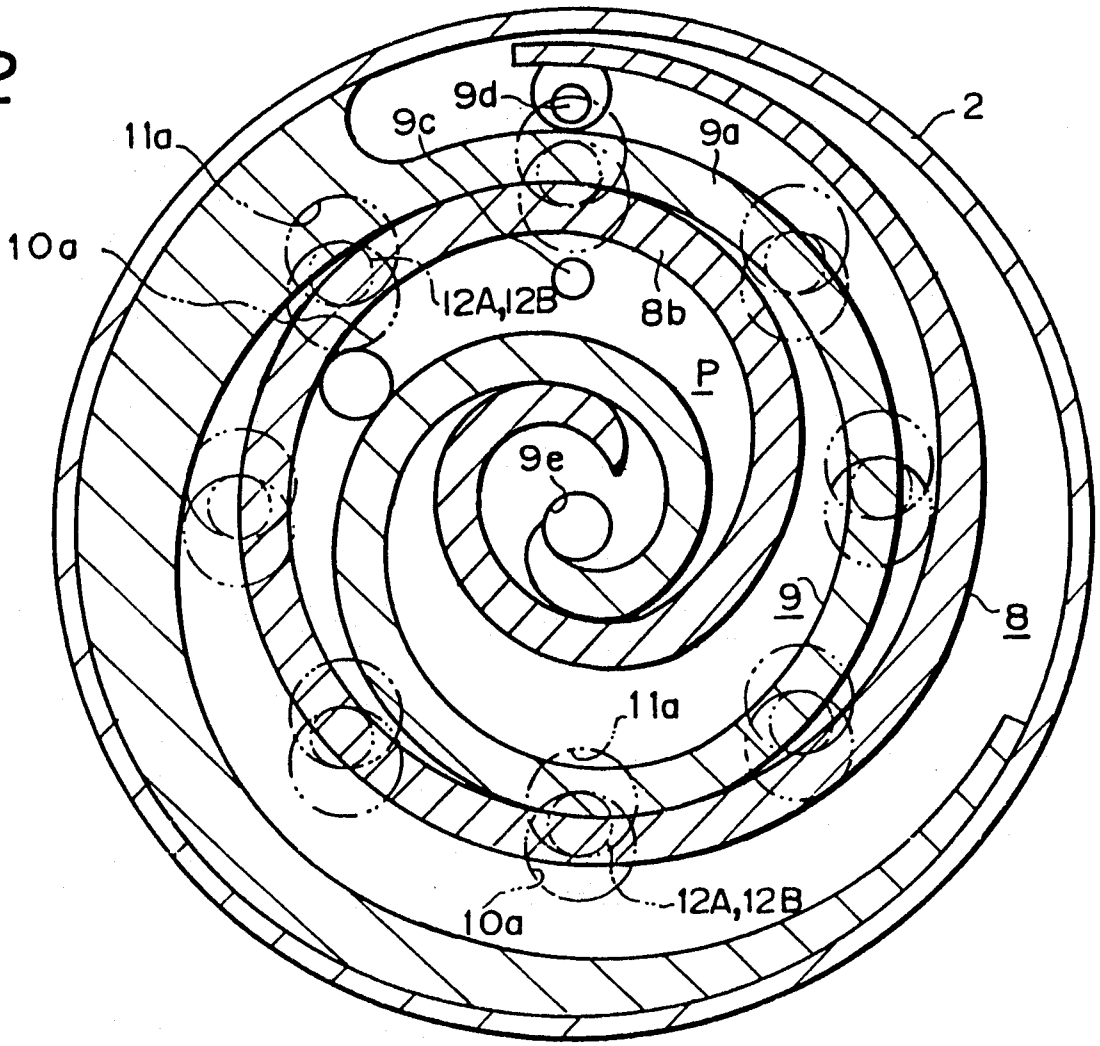

As shown in FIG. 1, a front housing 1 and a rear housing 2 are connected through an annular stationary substrate 3 located therebetween. The front housing 1 is provided with a rotational shaft 4 having an increased diameter portion 4*a* on which an eccentric shaft 5 is fixed and projects into the rear housing 2. The eccentric shaft 5 rotatably supports a balance weight 6 and a bush 7, and bush 7 rotatably supports a movable scroll 8. A stationary scroll 9 is secured in and to the rear housing 2 so that it is opposed to the movable scroll 8 in the rear housing 2, whereby a closed chamber P is defined by the respective base end walls 8*a* and 9*a* and the respective scroll portions 8*b* and 9*b* of the movable scroll 8 and the stationary scroll 9.

On the surface of the substrate 3 opposed to the movable scroll 2 is secured a stationary ring 10 provided with a plurality of circular through holes 10*a* spaced from one another at an equiangular distance, to restrict the revolutional angular position of the movable scroll 8. Further, a movable ring 11 secured to the opposite surface (rear surface) of the base end wall 8*a* of the movable scroll 8 has, similar to the revolutional angular position restricting holes 10*a*, a plurality of circular through holes 11*a* spaced from one another at an equiangular distance, to restrict the revolutional angular position of the movable scroll 8, corresponding to the revolutional angular position restricting holes 10*a*. To each of the revolutional angular position restricting holes 10*a* and the revolutional angular position restricting holes 11*a* are inserted circular disk-shaped shoes 12A and 12B having a diameter smaller than that of the corresponding revolutional angular position restricting holes 10*a* and 11*a*, respectively. Balls 13 are located between the respective opposing shoes 12A and 12B.

The shoes 12A, 12B and the associated balls 13 are pressed against each other by the compression reaction between the stationary substrate 3 and the movable scroll 8, to be integral with each other. The shoes 12A and 12B are movable in the revolutional angular position restricting holes 10*a* and 11*a* along the inner periphery thereof. The radius of the center track of the movement of the revolutional angular position restricting holes 11*a* is identical to the radius R of the revolution of the movable scroll 8, which is defined by the distance of the eccentricity of the center axis of the movable scroll and the center axis of the rotational shaft 4. Consequently, all of the shoes 12A and 12B rotate along the inner peripheries of the associated revolutional angular position restricting holes 10*a* and 11*a* in the same direction while being held between the latter when the eccentric shaft 5 revolves, so that movable scroll 8 revolves without rotating about its own axis.

On the peripheral wall of the front housing 1 is formed an introduction passage 1*a* through which the coolant is introduced, so that the coolant introduced into the front housing 1 through the inlet 1*a* is introduced to the closed chamber P between the scrolls 8 and 9 through the passage formed on the stationary substrate 3. The closed chamber P moves toward the starting end of the scroll portion 8*b* while reducing the volume thereof during the revolution of the movable scroll 8. As a result, the coolant in the closed chamber P is gradually compressed, whereby the compressed coolant in the movable scroll 8 and the stationary scroll 9 is discharged into a discharge chamber 15 on the rear side of the base end wall 9*a* of the stationary scroll 9 through a discharge port 9*a* openably closed by a discharge valve 14.

In the inlet 1*a* is provided a restriction spool 16 slidable in directions perpendicular thereto and having a central reduced diameter portion 16*a* having a length identical to the diameter of the inlet 1*a*. The restriction spool 16 is biased by a pressing spring 17 located in a closed chamber 50 formed in the front housing 1. The opposite end of the restriction spool 16 defines a pressure control chamber S1 in the front housing 1. The restriction spool 16 is continuously biased by the spring 17 to reduce the cross sectional area (passage area) of the introduction passage 1*a*, i.e., the volume of the pressure control chamber S1.

Between the stationary scroll 9 and the rear housing 2 is formed an intermediate pressure chamber 2*a* isolated from the discharge chamber 15. A pair of through passages 9*c* and 9*d* are formed in the base end wall 9*a* of the stationary scroll 9 to be adjacent to each other through the wall of the scroll portion 9*b*. The through passages 9*c* and 9*d* are connected to the intermediate pressure chamber 2*a*, so that a by-pass passage L, defined by the through passages 9*c* and 9*d* and the intermediate pressure chamber 2*a*, connects the portion of the suction pressure area located in the vicinity of the outer periphery of the rear housing 2 and the closed chamber P adjacent thereto, through the scroll portion 9*b*. In the by-pass passage L, between the intermediate pressure chamber 2*a* and the through passage 9*d*, is provided an opening and closing spool 18 located in the rear housing 2, to open and close the by-pass passage L. The opening and closing spool 18 is continuously biased by a spring 19 provided in the by-pass passage L in a direction in which the by-pass passage L is opened. A check valve 20 is provided in the intermediate pressure chamber 2*a* to open the through passage 9*d*.

The movement of the opening and closing spool 18 is controlled by controlling the feed of the coolant into a second pressure control chamber S2, which is defined by the opening and closing spool 18 in the rear housing 2. The feed of the coolant pressure into the pressure control chamber S2 is controlled by a control valve mechanism 21. The control valve mechanism 21 is provided with a valve housing 22 having a ball valve 23 therein connected to a diaphragm 24 through a rod 23*a*. An inlet port 22*a* formed on the peripheral surface of the valve housing 22 is connected to the suction chamber in the rear housing 2.

Further, another inlet port 22*b* formed on the lower surface of the valve housing 22 is connected to the discharge pressure chamber 15, and outlet ports 22*c* and 22*d* formed on the peripheral surface of the valve housing 22 are connected to the pressure control chambers S1 and S2, respectively.

A closed pressure chamber 22*e*, defined by the diaphragm 24 in the valve housing 22, is connected to the introduction passage (inlet) 1*a*, so that the pressure of the coolant introduced before the restriction spool 16 is introduced into the pressure chamber 22*e*. When the suction pressure is high, namely, when the cooling load is high, the diaphragm 24 is moved up in FIG. 1, so that the ball valve 23 is raised to close the first inlet port 22*a* and open the second inlet port 22*b*. As a result, the discharged coolant in the discharge chamber 15 is fed into the pressure control chambers S1 and S2, whereby the pressure in the pressure control chambers S1 and S2 is increased to the discharge pressure.

On the contrary, when the suction pressure is low, i.e., when the cooling load is low, the diaphragm 24 is moved down in FIG. 1, so that the ball valve 23 opens the first inlet port 22*a* and closes the other inlet port 22*b*. Consequently, the suction chamber in the rear housing 2 is communicated with the pressure control chambers S1 and S2, and thus the pressure in the control chambers S1 and S2 is reduced to the suction pressure.

When the pressure in the pressure control chamber S1 becomes high and corresponds to the discharge pressure, the restriction spool 16 is moved to the left in FIG. 1 against the spring 17, so that the reduced diameter portion 16*a* of the restriction spool 16 is exactly in registration with the introduction passage 1*a*, whereby the maximum cross sectional area of the passage of coolant is realized.

When the pressure in the second control chamber S2 is high and corresponds to the discharge pressure, the opening and closing spool 18 is moved to the left in FIG. 1 against the spring 19, to close the by-pass passage L. As a result, no coolant in the closed chamber P, which is being reduced in volume, is returned to the suction area through the by-pass passage L.

When the pressure of the pressure control chamber S1 becomes a low value corresponding to the suction pressure, the restriction spool 16 is moved so that the large diameter portion thereof enters the introduction passage 1*a*, to restrict the cross sectional area of the introduction passage 1*a*. Similarly, when the pressure in the pressure control chamber S2 becomes a low value corresponding to the suction pressure, the opening and closing spool 18 is moved to the right in FIG. 1 by the spring 19, to open the by-pass passage L. As a result, the coolant in the closed chamber P, which is being reduced in volume, is returned to the suction area through the by-pass passage L.

Namely, the suction restriction mechanism composed of the restriction spool 16, the pressing spring 17, and the pressure control chamber S1, and the by-pass opening and closing mechanism composed of the opening and closing spool 18, the pressing spring 19, and the pressure control chamber S2 are controlled, in association with each other, in accordance with the selective feeding of the discharge pressure or suction pressure controlled by the control valve mechanism 21. The by-pass opening and closing mechanism in which the capacity variability is lowered as the rotational speed of the compressor is increased and the suction restriction mechanism in which the capacity variability is increased as the rotational speed of the compressor is lowered compensate for the respective weak rotational speed ranges in which a sufficient capacity variability cannot be obtained.

The control of the by-pass passage L and the control of the restriction of the introduction passage la are performed by the selective introduction of the discharge pressure and the suction pressure in accordance with the detection of the suction pressure before being restricted, in which the cooling load is reflected. Namely, the suction pressure before the restriction in which a cooling load is reflected is not directly used as a drive for varying the capacity but is used to switch the control valve mechanism 21, and accordingly, the provision of the control valve mechanism 21 which selectively feeds the suction pressure and the discharge pressure ensures a precise and certain control of both the by-pass opening and closing mechanism and the suction restriction mechanism. Thus, the compensating function of the variability over the rotational speed range of the compressor of from a high speed to a low speed can be easily optimized, and consequently, a stable and steady capacity variability can be achieved within the entire rotational speed range.

It should be appreciated that the present invention is not limited to the above-mentioned embodiment. For example, as an alternative, it is possible to selectively feed one of the discharge pressure and the suction pressure into the pressure control chambers S1 and S2 by controlling the switching of an electromagnetic valve based on a detection signal of the suction pressure on which the cooling load is reflected.

We claim:

1. In a scroll type of compressor having a stationary scroll, a movable scroll opposed to the stationary scroll and rotatable thereabout but not rotatable about its own axis, so that a closed chamber which is reduced in volume during the rotation of the movable scroll is defined by and between the stationary scroll and the movable scroll, and an introduction passage through which a coolant is introduced in the compressor, wherein a capacity varying apparatus comprises a suction restriction mechanism provided in the introduction passage to control the cross sectional area thereof in accordance with a pressure of the coolant, a by-pass passage extending through the stationary scroll to connect the portion of the closed chamber connected to start ends of scroll portions provided on the movable and stationary scrolls, while being reduced in volume, to a suction pressure area in the compressor, a by-pass opening and closing mechanism provided in the by-pass passage to open and close the by-pass passage in accordance with the pressure of the coolant, and a control valve means actuated in accordance with the pressure of the coolant before being restricted, to control the operation of the suction restriction mechanism and the by-pass opening and closing mechanism in association with each other.

2. A capacity varying apparatus in a scroll type of compressor according to claim 1, wherein said scroll portions are formed at base end walls of the stationary scroll and the movable scroll.

3. A capacity varying apparatus in a scroll type of compressor according to claim 1, wherein said compressor further comprises a front housing and a rear housing connected to the front housing through an intermediate substrate provided therebetween to define a passage for the coolant.

4. A capacity varying apparatus in a scroll type of compressor according to claim 3, wherein said compressor further comprises a rotational shaft having eccentric shaft.

5. A capacity varying apparatus in a scroll type of compressor according to claim 4, wherein said movable scroll is rotatably supported by the eccentric shaft through a bush which is rotatably supported by the eccentric shaft.

6. A capacity varying apparatus in a scroll type of compressor according to claim 5, further comprising a stationary ring connected to the substrate and a movable ring connected to the movable scroll.

7. A capacity varying apparatus in a scroll type of compressor according to claim 6, wherein said stationary ring has a plurality of revolution restricting circular holes of the movable scroll and wherein said movable ring has a plurality of revolution restricting circular holes corresponding to the revolution restricting holes of the stationary ring.

8. A capacity varying apparatus in a scroll type of compressor according to claim 7, further comprising a plurality of circular disc-shaped shoes located in the associated revolution restricting holes of the stationary ring and the movable ring and having a diameter smaller than the diameter of the revolution restricting holes.

9. A capacity varying apparatus in a scroll type of compressor according to claim 8, further comprising a plurality of balls located between the corresponding shoes.

10. A capacity varying apparatus in a scroll type of compressor according to claim 9, wherein said shoes are movable in the corresponding revolution restricting holes while rotating therein along the circumferences of the associated revolution restricting holes when the eccentric shaft rotates to rotate the movable scroll without being rotated about their own axes.

11. A capacity varying apparatus in a scroll type of compressor according to claim 10, wherein said suction restriction mechanism comprises slidable restriction spool provided in the introduction passage to control the cross sectional area thereof.

12. A capacity varying apparatus in a scroll type of compressor according to claim 11, wherein said suction restriction mechanism further comprises a first pressure control chamber which is defined by the restriction spool in the front housing and in which the pressure of the coolant can be introduced.

13. A capacity varying apparatus in a scroll type of compressor according to claim 10, wherein said by-pass opening and closing mechanism comprises a movable opening and closing spool provided in the by-pass passage to open and close the by-pass passage.

14. A capacity varying apparatus in a scroll type of compressor according to claim 13, wherein said by-pass opening and closing mechanism further comprises a second pressure control chamber which is defined by the movable opening and closing spool and in which the pressure of the coolant can be introduced.

15. A capacity varying apparatus in a scroll type of compressor according to claim 13, wherein said first pressure control chamber is selectively connected to the suction coolant and the discharge coolant through the control valve means.

16. A capacity varying apparatus in a scroll type of compressor according to claim 13, wherein said second pressure control chamber is selectively connected to the suction coolant and the discharge coolant through the control valve means.

* * * * *